US008631850B2

(12) United States Patent
Fayette et al.

(10) Patent No.: US 8,631,850 B2
(45) Date of Patent: Jan. 21, 2014

(54) WINDOW ASSEMBLY

(75) Inventors: Mark Lee Fayette, Lake City, MN (US); Patrick Jerome Murphy, Lake City, MN (US)

(73) Assignee: Lake City Windows, Lake City, MN (US)

( * ) Notice: Subject to any disclaimer, the term of this patent is extended or adjusted under 35 U.S.C. 154(b) by 0 days.

(21) Appl. No.: 13/368,972

(22) Filed: Feb. 8, 2012

(65) Prior Publication Data

US 2012/0199294 A1 Aug. 9, 2012

Related U.S. Application Data

(60) Provisional application No. 61/440,667, filed on Feb. 8, 2011.

(51) Int. Cl.
*E06B 9/40* (2006.01)

(52) U.S. Cl.
USPC ..... 160/27; 160/100; 49/121

(58) Field of Classification Search
USPC ..... 160/27, 28, 100; 49/119, 121
See application file for complete search history.

(56) References Cited

U.S. PATENT DOCUMENTS

| | | | | | |
|---|---|---|---|---|---|
| 1,119,365 | A | * | 12/1914 | Morris | 49/99 |
| 1,916,681 | A | * | 7/1933 | Nagel | 49/149 |
| 2,051,422 | A | * | 8/1936 | Rissmann | 160/25 |
| 2,180,780 | A | * | 11/1939 | Summers | 160/25 |
| 2,332,979 | A | * | 10/1943 | Felix | 49/121 |
| 2,406,761 | A | * | 9/1946 | Golkowski | 160/100 |
| 2,418,014 | A | * | 3/1947 | Daab | 49/99 |
| 2,432,808 | A | * | 12/1947 | Royak | 160/27 |
| 2,514,274 | A | * | 7/1950 | Zagrodny | 160/27 |
| 3,022,547 | A | * | 2/1962 | Stegley et al. | 49/121 |
| 3,065,507 | A | * | 11/1962 | Cloutier et al. | 49/63 |
| 3,945,149 | A | * | 3/1976 | Boucher | 49/121 |
| 4,551,881 | A | | 11/1985 | Hoffman | |
| 4,570,382 | A | | 2/1986 | Suess | |
| 2010/0018123 | A1 | | 1/2010 | Hendrickson | |
| 2011/0107672 | A1 | | 5/2011 | Curtis | |

FOREIGN PATENT DOCUMENTS

| | | |
|---|---|---|
| EP | 0204057 | 12/1986 |
| EP | 0760892 | 3/1997 |
| NZ | 204201 | 2/1987 |

* cited by examiner

*Primary Examiner* — David Purol
(74) *Attorney, Agent, or Firm* — Dicke, Billig & Czaja, PLLC

(57) ABSTRACT

A window assembly including a first sash and a second sash, the first and second sashes each including a pane of glass disposed between a pair of horizontal rails and a pair of vertical stiles, a frame configured to retain the first and second sashes along a vertical plane of the frame, and a mechanism configured to simultaneously and correspondingly move a second sash in second direction upon movement of a first sash in a first direction opposite the second direction.

20 Claims, 8 Drawing Sheets

WINDOW ASSEMBLY

CROSS-REFERENCE TO RELATED APPLICATIONS

This Non-Provisional Patent Application claims priority to U.S. Provisional Application No. 61/440,667, entitled "Window Assembly", filed on Feb. 8, 2011, and incorporated herein by reference.

BACKGROUND

The present invention relates generally to window assemblies used in residential and commercial buildings. The window assembly provides a view to the exterior of the building while also providing a barrier against weather including wind, rain and snow. The window assembly may be used in replacement, remodeling and new construction. For example, the window assembly is suitable for use in enclosed porches, three season room, and cabins.

One known window assembly is a double-hung style window assembly. Typical double-hung window units include two sashes which move vertically along inside tracks that are integral to the frame, with the weight of the sashes being counterbalanced with a weight or held stationary to restrict movement. The double-hung window units must be able to withstand forces of gravity and wind, yet remain operable to users. Typical double-hung window units often require the user to exert excessive effort to force the window unit open or closed and the operation of the window unit is often noisy. Additionally, screens must be seasonally installed and removed.

For these and other reasons, there is a need for the present invention.

SUMMARY

One aspect provides a window assembly including a first sash and a second sash, the first and second sashes each including a pane of glass disposed between a pair of horizontal rails and a pair of vertical stiles, a frame configured to retain the first and second sashes along a vertical plane of the frame, and a mechanism configured to simultaneously and correspondingly move a second sash in second direction upon movement of a first sash in a first direction opposite the second direction.

DETAILED DESCRIPTION

In the following Detailed Description, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
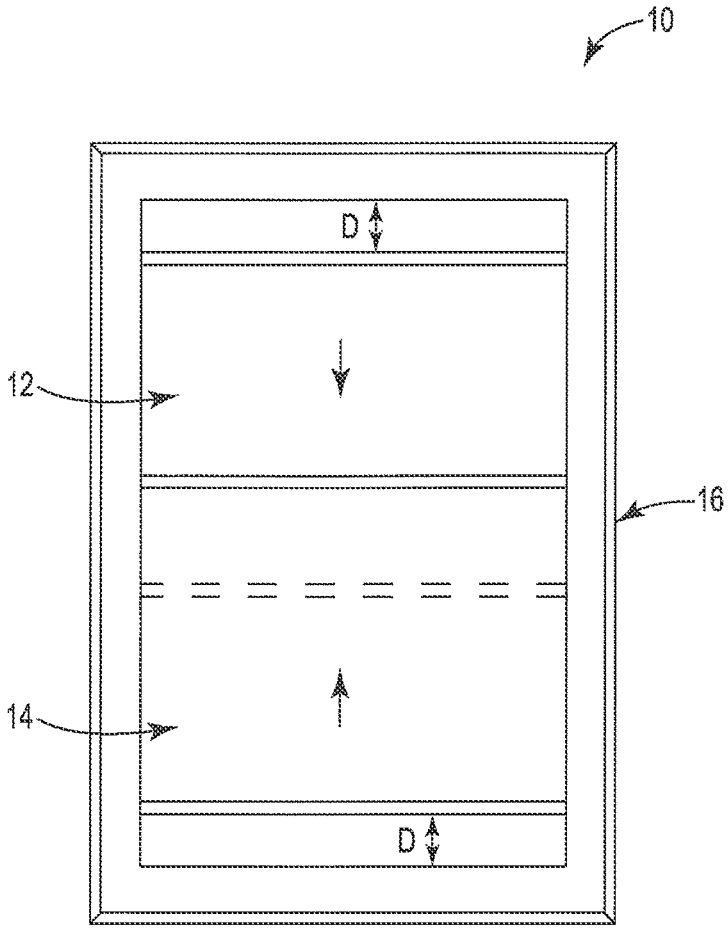
FIG. 1 is a front view of a window assembly according to one embodiment.

FIG. 1 illustrates a front view of a window assembly 10 according to one embodiment. The window assembly 10 is a double-hung window and includes an upper sash 12, a lower sash 14, and a frame 16. The upper sash 12 and the lower sash 14 are vertically moveable within the frame 16. Details on the various components are provided below. In general terms, however, window assembly 10 includes a mechanism whereby movement of one of the upper sash 12 or lower sash 14 causes a corresponding movement of the other sash 12 or 14 in an opposite direction, as indicated by the arrows. The sashes 12, 14 move an equal distance D in opposite directions.

Figure 2:
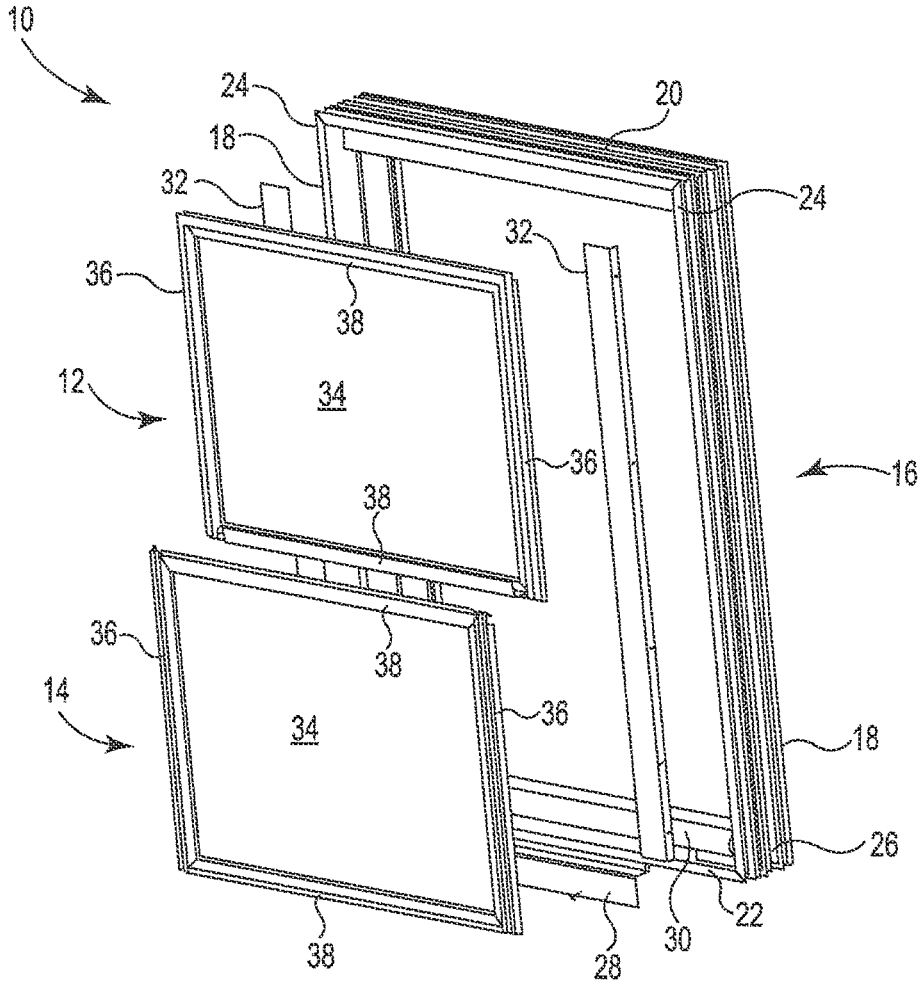
FIG. 2 is a perspective view of the window assembly according to one embodiment.

FIG. 2 illustrates a perspective view of one embodiment of the window assembly 10. The frame 16 includes a pair of vertical side jambs 18, an upper horizontal header 20, and a lower horizontal sill 22. The upper horizontal header 20 is coupled to first ends 24 of two vertical side jambs 18 and the lower horizontal sill 22 is coupled to the second ends 26 of the two vertical side jambs 18. In this manner, the frame 16 is formed in a rectangular shape, although other geometric shapes are also acceptable. In addition, screen covers 28 may be attached to the sill 22 and header 20 to protect a screen roll 30 coupled to the sill 22 and header 20, respectively. Inside stops 32 are coupled to the jambs 18 on to secure the upper and lower sashes 12, 14 within the frame 16 on an interior side.

In one embodiment, the window assembly 10 is factory assembled to order and shipped as a ready-to-install product. The frame 16 is low profile and is configured to extend minimally into a rough opening and provide the greatest visibility. In one embodiment, the jambs 18, header 20, and sill 22 each have a thickness of approximately 2-¼" to 2-½", and thus, the frame extends into the rough opening 2-¼" to 2-½" on all sides. The frame 16 is configured to be installed in standard wall construction and is 3-½" deep. The window assembly 10 may be fabricated in any suitable size. In one embodiment, the window unit is 8'×10' and extends from floor-to-ceiling. The window assemblies 10 may be installed side-by-side in a series. Specially designed, extruded aluminum is used in the frame 16 and the sashes 12, 14. In one embodiment, the frame 16 is extruded aluminum alloy and is powder coated in the desired finish. Extruded aluminum materials provide for minimal maintenance over many years of use.

With the above in mind, the upper and lower sashes 12, 14, or pane assemblies, are slidable relative to and within the frame 16 and include panes of glass 34 framed with stiles 36 (vertical) and rails 38 (horizontal). The upper and lower sashes 12, 14 are sized to seal an upper and a lower portion, respectively, of the window assembly 10 within the frame 16. The upper and lower sashes 12, 14 have substantially the same mass, and typically, the same size. The upper and lower sashes 12, 14 are slidably coupled within the frame 16 along tracks formed along opposing vertical jambs 18 as further described below.

Figure 3:
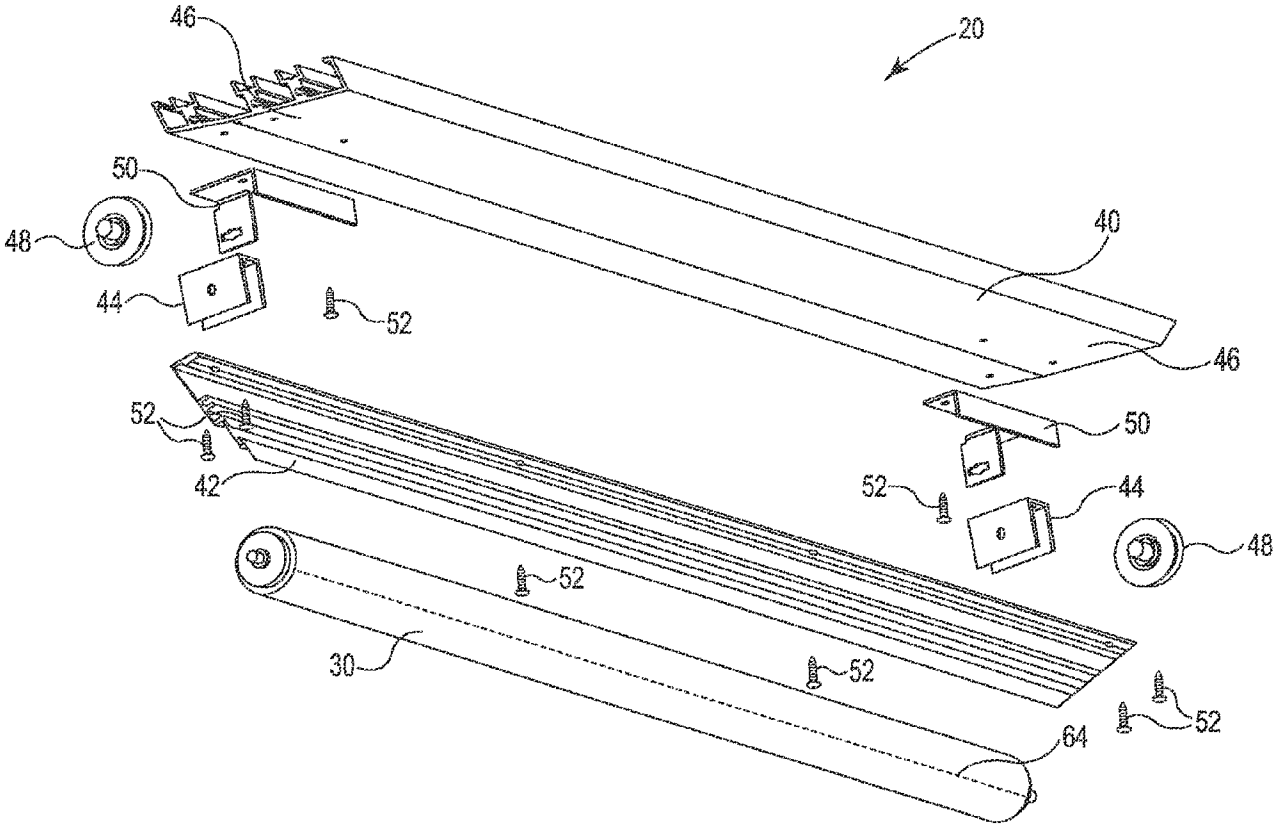
FIG. 3 is a perspective view of a header of the window assembly according to one embodiment.

FIG. 3 illustrates the header 20 of window assembly 10 according to one embodiment. The horizontal header 20 includes an extruded channel 40 and a head stop 42. In one embodiment, a pulley bracket 44 is coupled to the opposing end portions 46 of the header 20. The pulley bracket 44 is configured to retain a pulley 48 to which a sash cord (not shown) is movable along. With additional reference to FIG. 1, the pulley brackets 44 are positioned proximal to the jambs 18 when assembled and the screen roller 30 and screen brackets 50 are positioned between the pulley brackets 44. Screen brackets 50 are sized and shaped in accordance with the size, shape, and retaining requirement of the screen roller 50 within the window assembly 10. Fasteners 52 such as screws or other attachment means are acceptable.

Figure 4:
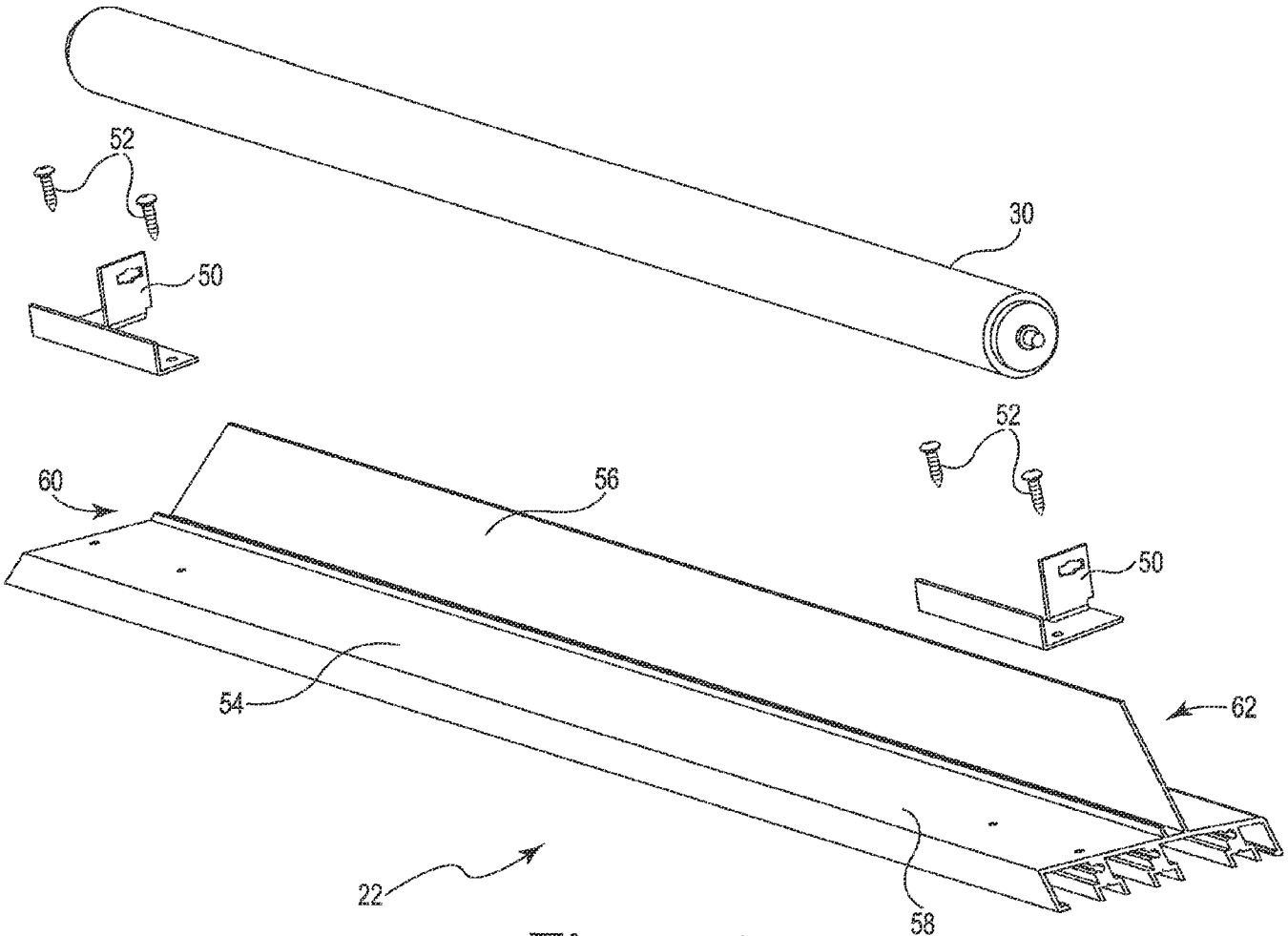
FIG. 4 is a perspective view of a sill of the window assembly according to one embodiment.

FIG. 4 illustrates the sill 22 of the window assembly 10 according to one embodiment. The sill 22 includes an extruded channel 54 which may have a variety of profiles and have a profile similar to the extruded channel 40 of the header 20. The sill 22 also includes an elongated member 56 extending perpendicularly from a top face 58 of the sill 22. The elongated member 56 separates an interior portion 60 from an exterior portion 62 of the sill 22. In one embodiment, the interior portion 60 includes the screen roller 30 and screen brackets 50 at each end of the screen roller 30 to couple the screen roller 30 to the top face 58 of the sill 22.

Figure 5:
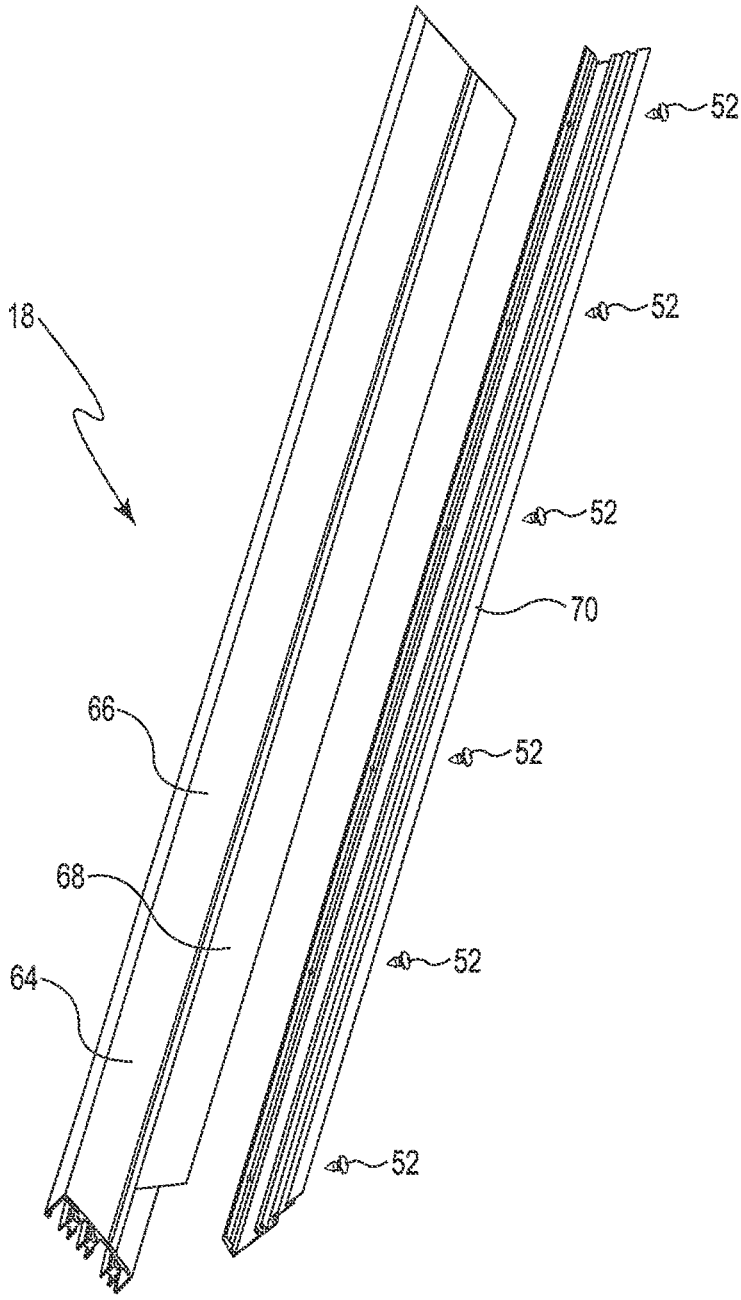
FIG. 5 is a perspective view of a jamb of the window assembly according to one embodiment.

FIG. 5 illustrates one of the pair of jambs 18 of the window assembly 10 according to one embodiment. The jamb 18 is an extruded channel 64 having a face 66 and an elongated track member 68 extending perpendicularly from the face 66. The elongated track member 68 is configured to extend between the upper and lower sashes 12, 14 when assembled with the frame 16. The jamb 18 includes an interior stop 32 (see FIG. 2) and an exterior stop 70, which, in combination with the elongated track member 68, forms interior and exterior vertical tracks or grooves in which the upper and lower sashes 12, 14 are slidably positioned when assembled.

Figure 6A:
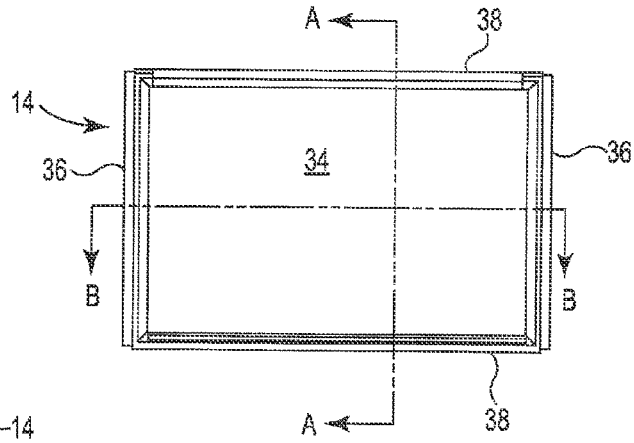
FIG. 6*a* is a front view of a lower sash of the window assembly according to one embodiment.
Figure 6B:
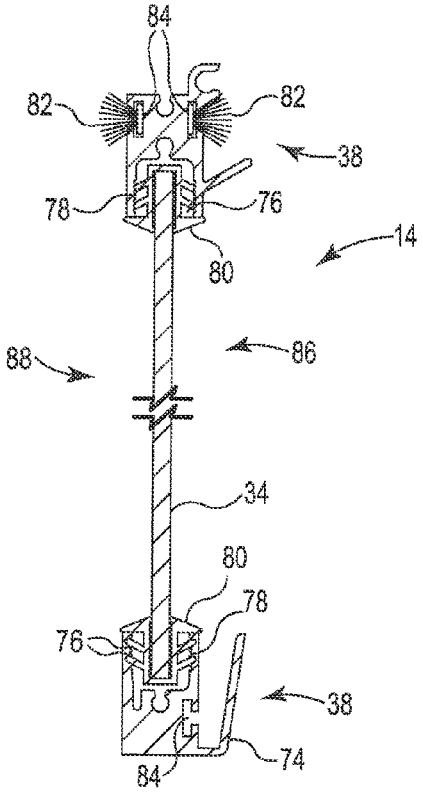
FIGS. 6*b*-6*c* are sectional views of the lower sash of the window according assembly to the embodiment of FIG. 5*a*.
Figure 6C:
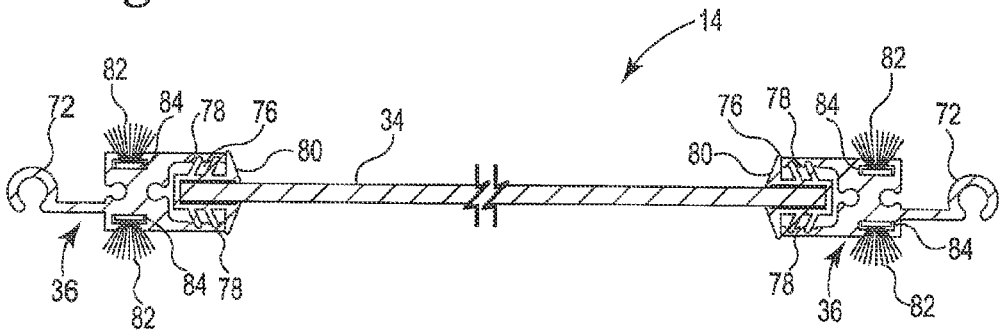

FIGS. 6*a*-6*c* illustrate the lower sash 12 of the window assembly 10 according to one embodiment. The upper and lower sashes 12, 14 are of rectangular or other form in order to be moveably coupled within the frame 16. The upper and lower sashes 12, 14 are extruded aluminum alloy. The lower and upper sashes 12, 14 are generally similar to one another; accordingly, only the lower sash 14 is described in detail, the upper sash 12 being the logical counterpart thereof. The upper and lower sashes 12, 14 include pairs of stiles 36 and rails 38. As further illustrated in FIG. 7, the stiles 36 and the rails 38 are shaped to accept sash cords, weather strip seals, screen splines, and screens as well as to guide the upper and lower sashes 12, 14 into secure positions when the sashes 12, 14 come to a fully closed or other desired position.

With further reference to FIG. 6*c*, a cross-section B-B of the lower sash 14, the stiles 36 include a track extension 72 configured for slidable engagement with the jamb 18 and an aperture sized to accommodate connection to the sash cord (not shown). The track extension 72 may be configured in a variety of forms suitable to provide slidable movement within the jamb 18 and prevent rattling of the sash 12, 14 against the jamb 18. Extending in a direction generally opposite the track extension 72, glass 34 is supported between a pair of opposing stiles 36 each of which define a plow opening 76 configured to receive the glass 34. The glass 34 may be any suitable thickness, for example ⅛" or ¼" thick. In one embodiment, a single pane of glass 34 is used. The plow opening 76 is defined by a pair of spaced, parallel, linear sidewalls 78. In one embodiment, the interior surface of the sidewalls 78 is ridged to cooperate with a glass stop 80.

With reference to FIG. 6*b*, a cross-section A-A of FIG. 6*a*, the glass 34 of the lower sash 14 is also supported between a pair of opposing rails 38. The upper rail 38 of the lower sash 14 (and correspondingly, the lower rail of the upper sash 12) includes an interlock 74 projected at an acute angle to the glass 34. Similar to the stiles 36, the rails 38 include plow opening 76 for retain perimeter edges of the glass 34. In one embodiment, the interior surface 78 of the plow opening 76 is ridged. In one embodiment, the stiles 36 and rails 38 extend approximately ½" beyond the glass 34 in order to be moveably secured in the frame 16 and provide maximum visibility. The glass 34 is inserted into the glass stop 80 which is correspondingly inserted into the plow openings 76 of the stiles 36 and rails 38 to secure the glass 34 within the sash 14.

The stiles 36, the rails 38, and the interlock 74 include weather strip seals 82 such as pile weather stripping, for example, for weather and bug penetration, quiet operation and appropriate sash to frame friction. The weather strip seal 82 is attached to a t-slot 84. The weather strip seal 82 has a suitable pile density so as to create a desired amount of friction and prevent rattling when the sashes 12, 14 are moved. In one embodiment, the weather strip seal 82 has a pile density of 35-40%. The upper and lower sashes 12, 14 include weather strip seal 82 on a least one of either an interior 86 or an exterior face 88 of the sash 12, 14. In one embodiment, the lower sash 14 further includes a lift handle 90 (see FIG. 7) located in the center of the upper rail 38. The lift handle 90 may also be operable as a latch which releasably creates tension between the sash 14 and the frame 16 and positions the sashes 12, 14 into a desired fixed position. For example, a latch system available from Ashland® Hardware Systems under the trade designation of DualTech may be used. Preferably, a single latch or lever actuates the tensioner, which may be spring-loaded or otherwise tensioned. Alternatively, the upper rail 38 of the lower sash 14 includes opposing commercially available latch bodies which releasably each creates tension against the respective jambs 18. Alternatively, tension between the upper sash 12 and lower sash 14 may be created with rubber cams.

Figure 7:
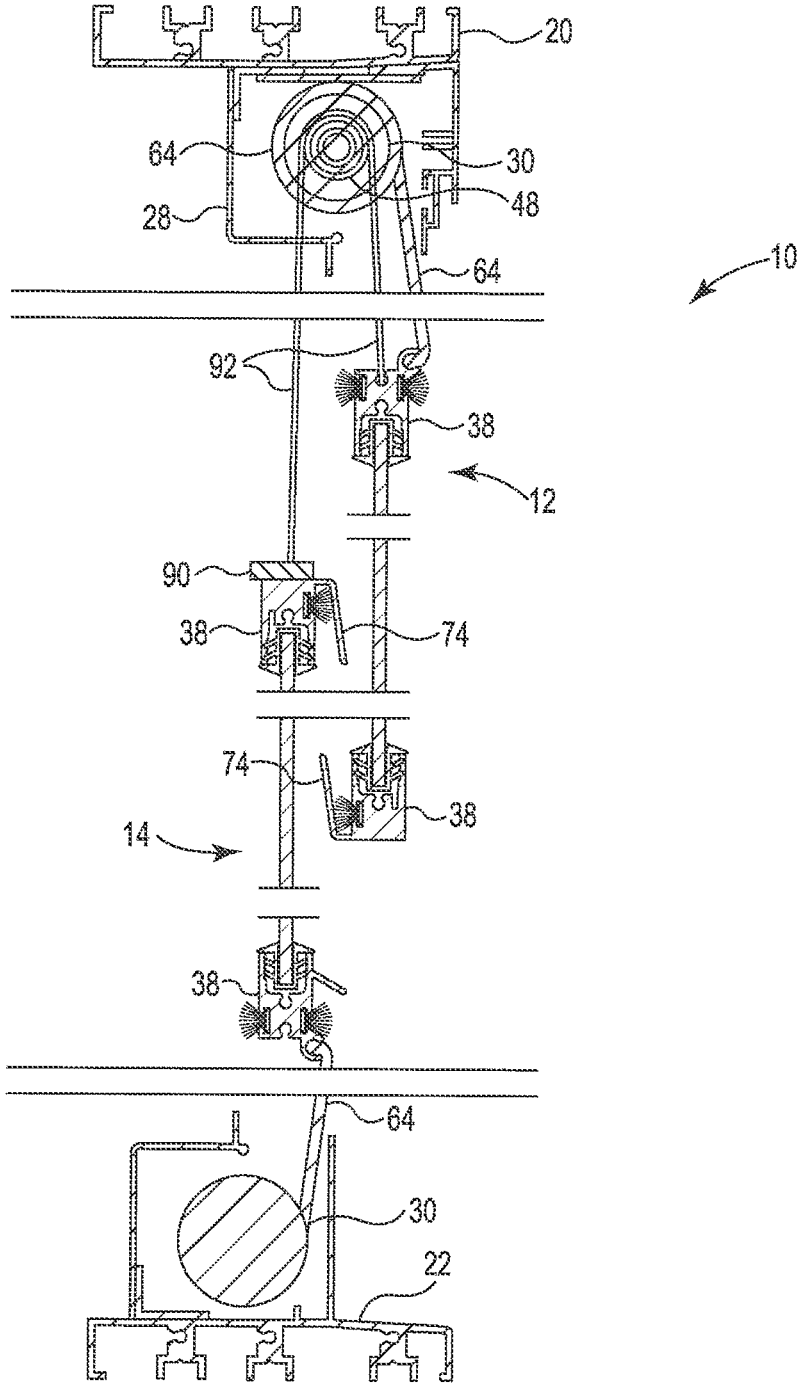
FIG. 7 is a sectional view of the window assembly according to one embodiment.

Additionally, as illustrated in FIG. 7, rolled screens 64 are retractable within the screen cover 28 at the header 20 and the sill 22 of the window assembly 10, and are therefore out of sight when not needed (e.g. windows closed position). The screen roller 30 is a tube and screen 64 is rolled around the tube. The screens 64 are attached to the rollers 30 and are biased by adjustable tension springs. The screens 64 are tensioned to retain a taunt, planar configuration when extended. The screens 64 may be suitable to prevent insects and other particulates from passing through the window assembly when the sashes 12, 14 are in an open position. The screen 64 is slightly wider than the sashes 12, 14 and extends into the jambs 18 in order to provide a seal across the window opening. In one embodiment, the screens 64 are coupled to the top rail 38 of the upper sash 12 and the bottom rail 38 of the lower sash 14, respectively, with screen brackets, fasteners, or screen spline. The screen 64 may be removed and replaced as needed.

With continued reference to FIG. 7, the upper and lower sashes 12, 14 are of substantially equal weight and size and are mechanically connected to each other using two sash cords 92 looped over the two pulleys 48. In one embodiment, the sash cord 92 is stainless steel aircraft grade cable. In one embodiment, the sash cords 92 are adjustable. When operated, movement of sash 14 cause movement of sash 12 through pulley assembly mechanism connecting the two sashes 12 and 14. Each of the two sashes 12, 14 move up and down simultaneously in opposite directions and on a vertical plane within the frame 16. The frame 16 holds the sashes 12, 14 within the vertical plane of the frame 16 while they are stationary and during operation and provides for optimum friction allowing smooth opening and closing operation. In one embodiment, the tension of the screen rollers 30 cause additional forces on the sashes 12, 14 connected to the screens 64 which must be counter acted with additional friction of the sashes 12, 14 to the frame 16 and/or the lift handle 90 latch or lever actuating a tensioner. The upper rail 38 of the lower sash 14 and the lower rail 38 of the upper sash 12 include interconnects 74 formed to interconnect when in a closed position. In one embodiment, the screens 64 extend between the screen cover 28 and the sill or header. The sash rail 38 extends to the sill 22 or the header 20 adjacent to the screen cover 28. In one embodiment, the sill 22 and the header 20 include screen covers 28 positioned on an inner surface of the frame 16 to cover the respective screen rollers 30 for both aesthetic and protective purposes.

As illustrated in FIGS. 8*a*-8*d*, the upper and lower sashes 12, 14 are moveable in opposing directions (up and down simultaneously) inside the frame 16. In one embodiment, when the window assembly 10 is opened, both sashes 12, 14 move in unison in opposite directions and the retractable screens 64 unroll and "follow" the respective sash 12, 14 through the full range of the sashes vertical motion in the frame 16. In this manner, the window assembly 10 provides an insect barrier when the sashes 12, 14 are both opened and closed and creates a weather resistant barrier that keeps drafts and moisture (rain and snow) from passing through the unit when closed.

Figure 8A:
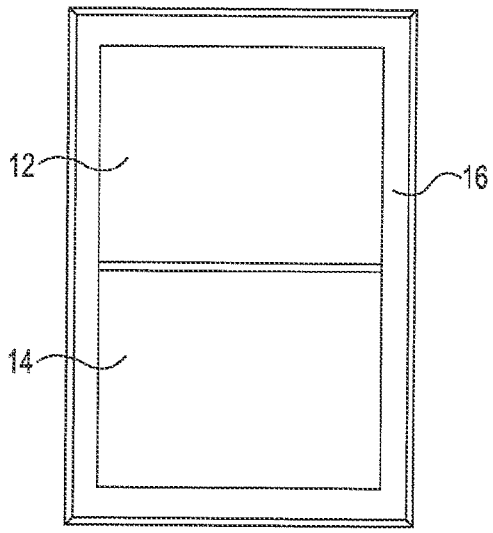
FIGS. 8*a*-8*d* are front views of the window assembly.
Figure 8B:
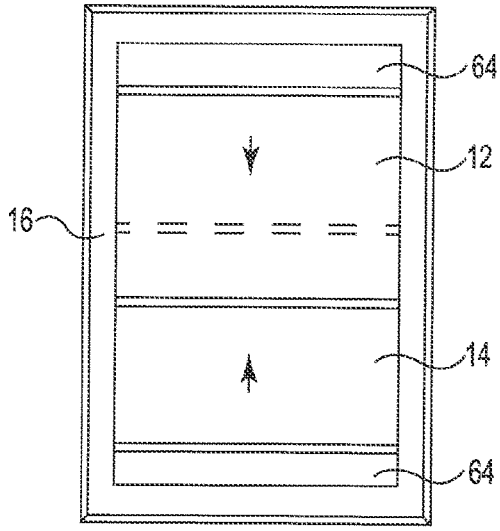
Figure 8C:
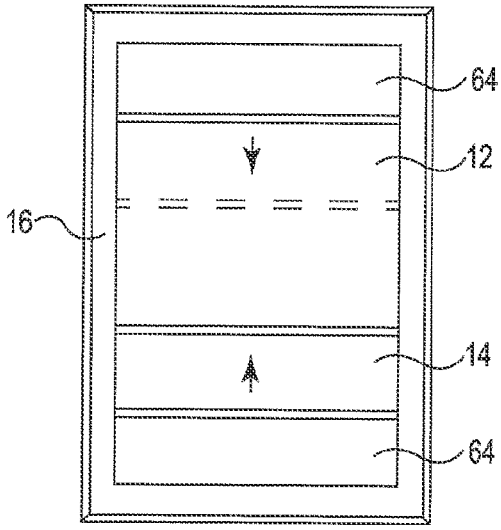
Figure 8D:
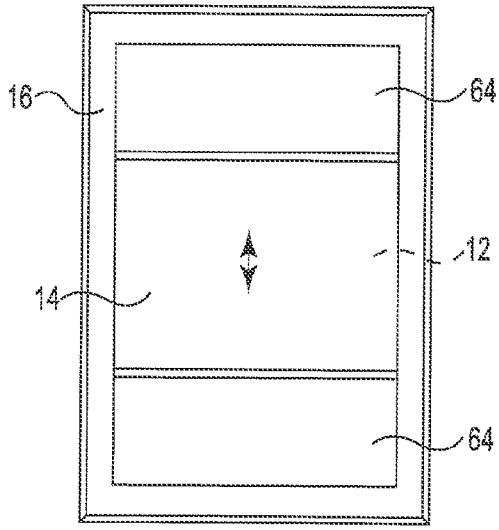

In a closed position, as illustrated in FIG. 8*a*, the screens 64 are fully retracted and the upper and lower sashes 12, 14 are fully extended across respective portions of the window opening. In this position, the operator's view through the closed window assembly 10 is not obscured by the screens 64. As illustrated in FIGS. 8*b*-8*c*, raising the lower sash 14 results in the upper sash 12 lowering by the same distance within the frame 16, thereby allowing a desired amount of air flow to flow through the window assembly 10 at both the top and the bottom of the window assembly 10 simultaneously. The window assembly 10 allows minimal user effort when operating a wide range of sash 12, 14 sizes due to the balancing effect of two sashes 12, 14 of equal weight and size on one another. FIG. 8*d* illustrates a fully opened window assembly 10, wherein the two sashes 12, 14 substantially overlap one another and the screens 64 are extended to cover approximately 50% of the window opening.

Opening of the sashes 12, 14 creates an immediate breeze, or turnover of air, even in the absence of a breeze due to the thermal qualities of the air inside the previously closed interior space. When sashes 12, 14 are in the open position air flow occurs both at the top and the bottom of the window assembly 10. Upon opening the window hot air at the top of the room is allowed to exhaust through the opened space above the upper sash and outside air is allowed entry through either, or both, of the opened spaces created by moving the two sashes. The natural movement of hot air rising and cooler air settling enhances air flow immediately upon opening the window and circulation of the inside and outside air results. Opening additional window assemblies 10 increase air flow as desired. Additionally, opening the window assembly 10 results in the sashes 12, 14 allowing air movement to circulate in a loop along the top and the bottom of the living space, thereby minimizing airflow that can cause discomfort and blow objects off tables while still allowing air movement inside the room.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A window assembly, comprising:

a first sash and a second sash, the first and second sashes each including a pane of glass disposed between a pair of horizontal rails and a pair of vertical stiles, wherein the horizontal rails and vertical stiles each include a plow opening defined by a pair of spaced apart parallel sidewalls configured to accommodate the pane of glass and a glass stop between the sidewalls;

a frame configured to retain the first and second sashes along a vertical plane of the frame; and a mechanism configured to simultaneously and correspondingly move a second sash in second direction upon movement of a first sash in a first direction opposite the second direction.

2. The window assembly of claim 1, wherein the first and second sashes are substantially equal weight.

3. The window assembly of claim 1, wherein the mechanism includes a pulley assembly coupling the first sash to the second sash.

4. The window assembly of claim 1, further comprising a first screen assembly attached along an edge of the first sash and a second screen assembly attached along an edge of the second sash, wherein the first and second screen assemblies are configured to cover open areas in the window assembly corresponding to the first and second sashes in open positions.

5. The window assembly of claim 4, wherein the first screen assembly includes a screen roller attached to a header of the frame and the second screen assembly includes a screen roller attached to a sill of the frame.

6. The window assembly of claim 1, wherein the first sash includes a latch assembly.

7. The window assembly of claim 1, wherein mechanism further comprises the second sash coupled to the first sash with a sash cord and the first and second sashes configured to counterbalance one another.

8. The window assembly of claim 1, wherein the first and second sashes each comprise a single pane of glass.

9. The window assembly of claim 1, wherein the first and second sashes each comprise a corresponding interlock configured to interconnect in a closed position.

10. A double-hung window assembly, comprising:

a frame including a sill, a header, and opposing jambs forming a window opening;

an upper and a lower sash each comprising of a pane of glass, and opposing rails and opposing stiles configured to secure the pane of glass, wherein the stiles are configured to be slidably disposed along the opposing jambs of the frame; and two rolling screen assemblies, one each disposed at the sill and the header of the frame, each of the two rolling screen assemblies including a screen roller and a screen, wherein each of the screens has an edge portion configured to attach along one of the rails of the upper and lower sashes;

wherein the screens are extendable toward a centerline of the frame, wherein the upper and lower sashes are configured to be simultaneously moveable in opposite directions upon movement of one of the sashes, and wherein the rolling screen assembly disposed at the sill is aligned along a plane of the lower sash and the rolling screen assembly disposed at the header is aligned along a plane of the upper sash.

11. The double-hung window assembly of claim 10, wherein each of the two sashes further comprise weather stripping along a perimeter of at least one of an interior or exterior surface.

12. The double-hung window assembly of claim 10, further comprising a pulley assembly configured along each of the opposing jambs, each pulley assembly having a pulley and a sash cord, wherein the upper and lower sashes are coupled to the pulley assembly by the sash cord.

13. The double-hung window assembly of claim 10, wherein each of the two screens extends across a width of the window opening and into the opposing jambs of the frame.

14. The double-hung window assembly of claim 10, further comprising a screen cover partially enclosing the screen rollers of the two rolling screen assemblies.

15. The double-hung window assembly of claim 10, wherein upper and lower sashes are configured to releasably interlock along adjoining rails when in a closed position.

16. The double-hung window assembly of claim 10, wherein the lower sash assembly further comprises a lift handle.

17. The double-hung window assembly of claim 12, wherein each pulley assembly is coupled to the header adjacent to the opposing ends of the screen roller.

18. The double-hung window of claim 10, wherein in the upper and lower sashes are configured to latch together.

19. The double-hung window of claim 14, wherein the screen covers include an opening aligned with one of the upper and lower sashes and configured to accept one of the stiles of the one of the upper and lower sashes.

20. The window assembly of claim 1, wherein the plow opening is configured to accommodate various thicknesses of the pane of glass.

* * * * *